US005669318A

United States Patent [19]

Tsay et al.

[11] Patent Number: 5,669,318

[45] Date of Patent: Sep. 23, 1997

[54] PORTABLE LOCK STITCH SEWING MACHINE

[75] Inventors: Shi-chour Tsay; Jen-hsin Ho, both of Taoyuan Hsien, Taiwan

[73] Assignee: Airtek Industry Corp., Taipei, Taiwan

[21] Appl. No.: 692,334

[22] Filed: Aug. 5, 1996

Related U.S. Application Data

[63] Continuation-in-part of Ser. No. 659,403, Jun. 6, 1996.

[51] Int. Cl.[6] ..... D05B 69/12; D05B 27/24

[52] U.S. Cl. ..... 112/169; 112/220; 112/324; 112/221

[58] Field of Search ..... 112/169, 220, 112/221, 237, 235, 323, 324, 228

[56] References Cited

U.S. PATENT DOCUMENTS

| | | | |
|---|---|---|---|
| 3,797,424 | 3/1974 | Cerioni | 112/169 |
| 3,834,333 | 9/1974 | Seyama | 112/169 |
| 4,463,695 | 8/1984 | Killinger | 112/169 X |
| 4,501,211 | 2/1985 | Seyama | 112/169 |
| 5,396,853 | 3/1995 | Huang | 112/169 |

*Primary Examiner*—Ismael Izaguirre

*Attorney, Agent, or Firm*—Peterson, Wicks, Nemer & Kamrath, P.A.

[57] ABSTRACT

A portable lock stitch sewing machine includs a driving mechanism, a transmitting mechanism and a number of guiding mechanisms. The function of the driving mechanism is to transfer a battery power to pivotally connected members to make them move as required by a user. The transmitting mechanism then transmits the power of the battery to related members to fulfill the sewing performance and the number of guiding mechanism are used to ensure the tension on threads.

8 Claims, 13 Drawing Sheets

PORTABLE LOCK STITCH SEWING MACHINE

This is a continuation in part (CIP) of U.S. patent application Ser. No. 08/659,403 filed on Jun. 6, 1996.

FIELD OF THE INVENTION

The present invention generally relates to a portable sewing machine and more particularly to a sewing machine for providing an upper and a lower thread to perform a lock stitch to the fabrics.

BACKGROUND OF THE INVENTION

This invention has a particular application to a portable sewing machine which comprises a driving means, a transmitting means and a plurality of guiding means. The portable sewing machine constructed in accordance with the present invention is a compact, hand held sewing machine. The transmitting means mounted within the apparatus drives a shuttle and a bobbin to move and thus creates an excellent sewing performance.

Prior hand held sewing machine, when sewing, provides only upper thread to a knitted material, thus the sewing machine can only form a loop upon every stitch, instead of a knot, which makes the knitted material very easy to be torn apart once a knitted thread is broken.

Although another kind of hand held, compact sewing machine having both the upper and the lower thread has been provided to the market, however, it still uses a user's holding strength as the power of the apparatus. Using the holding strength of a user as the power of the apparatus is very inefficient when sewing, and the user is very easy to feel exhausted, especially when the to-be knitted area is quite big.

The present invention provides an improved portable sewing machine using battery and/or AC adaptor as the power and providing functions other than sewing to mitigate and/or obviate the aforementioned problems.

SUMMARY OF THE INVENTION

The main objective of the invention is to provide a portable sewing machine comprising a driving means, a transmitting means, and a plurality of guiding means. The driving means uses batteries and/or AC adaptor as the only source of power, the transmitting means includes a plurality of gears, and rods which are pivotally connected to one another and the guiding means has a plurality of guiding elements to guide both the upper and the lower threads to a proper position.

Another objective of the invention is to provide a portable sewing machine which is compact and easy to use.

Still another objective of the invention is to provide a portable sewing machine which uses detachable gears to function as a bobbin winder in order to save a lot of effort winding thread onto a bobbin.

Other objects, advantages and novel features of the invention will become more apparent from the following detailed description when taken in conjunction with the accompanying drawings.

BRIEF DESCRIPTION OF THE DRAWINGS

The present invention will now be better understood with the reference of the accompanying drawings wherein.

DETAILED DESCRIPTION OF THE PREFERRED EMBODIMENT

Figure 1:
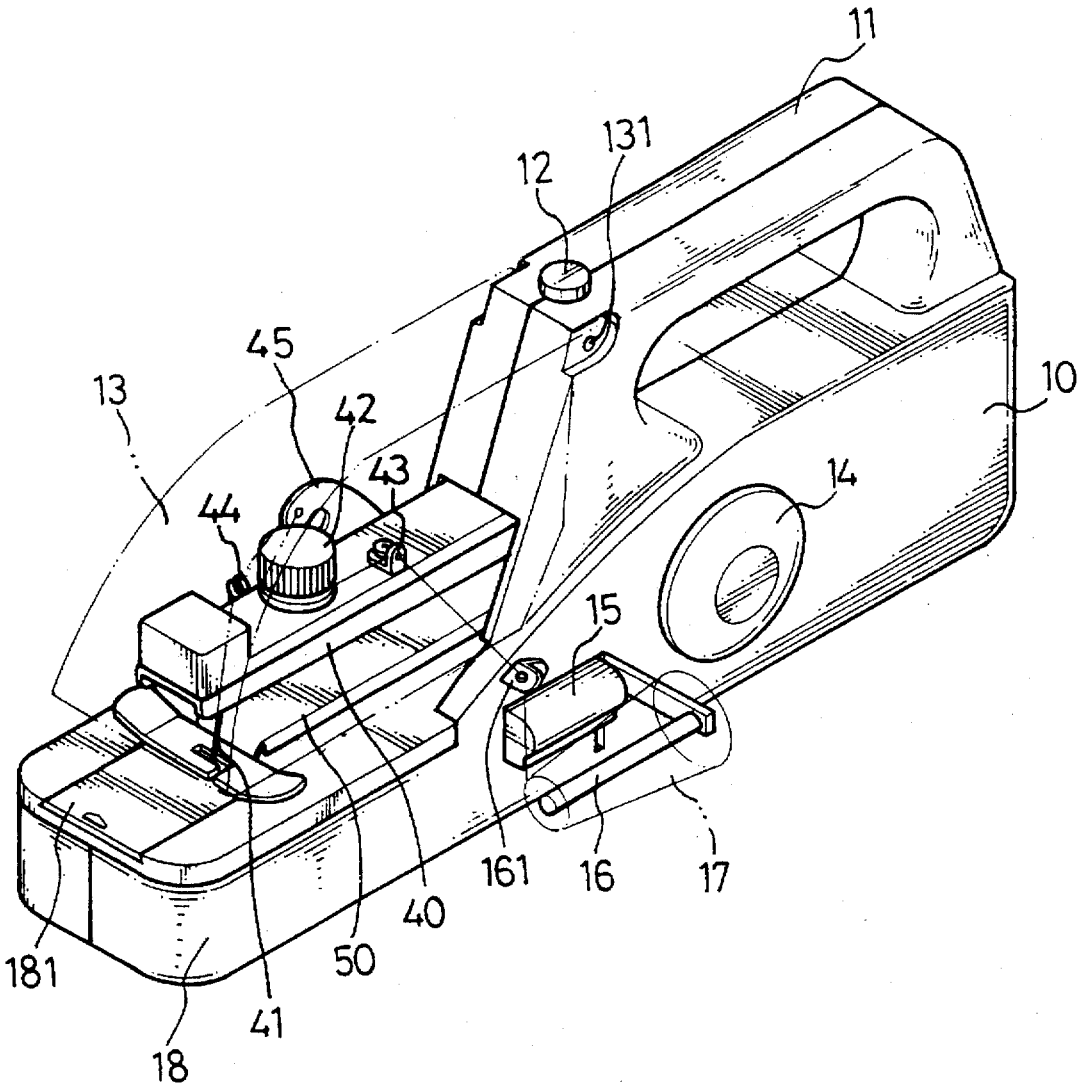
FIG. 1 is a schematic view of one preferred embodiment of the present invention.

Referring to the drawings and particularly FIG. 1, a portable lock stitch sewing machine is provided.

A handle 11 is mounted at a rear upper part of a main housing 10, and a power switch 12 is mounted in front of the handle 11. A needle arm cover 13 is pivotally connected to the main main housing 10 at both sides of the power switch 12 with holes 131. A manual adjusting wheel 14 and a spool stand 15 having a spool pin 16 are mounted on one side of the main housing 10 for receiving a spool thread 17. A first guider 161 is mounted on top of the spool stand 15 and the bed 18 extended integrally with the main housing 10 extends axially. A shuttle cover 181 is provided on top of the bed 18 so that a lower thread mechanism is received therein. The needle arm 40 able to move vertically is mounted on top of the bed 18. A spool thread tension dial 42 and a second guider 43, a third guider 44 and a forth guider 45 are provided along on the needle arm 40 for respectively adjusting the tension of the upper thread and guiding the upper thread to a proper position. A presser foot 50 is provided below the needle needle arm 40 and on the bed 18.

Figure 2:
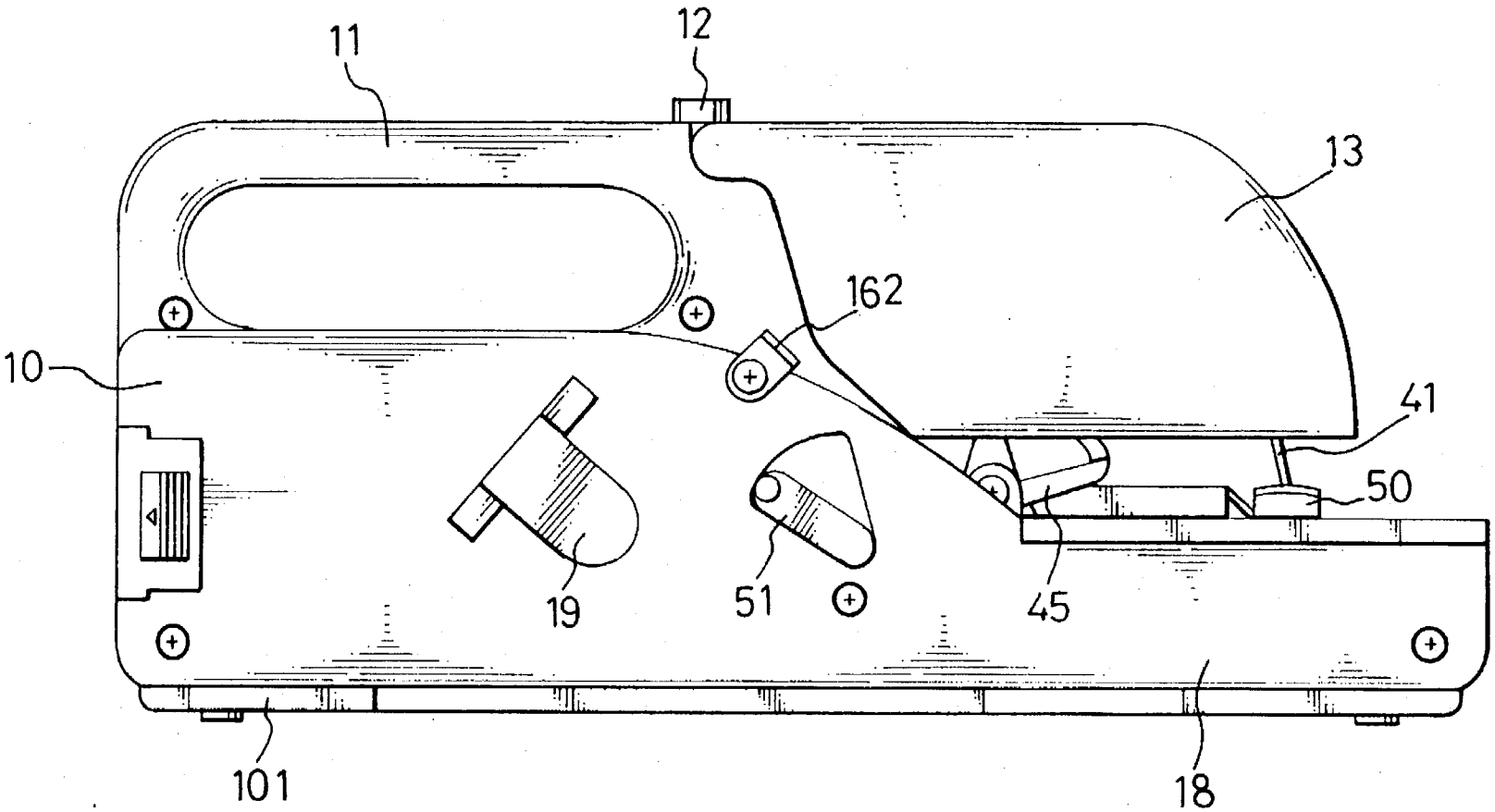
FIG. 2 is a side view of the invention.
Figure 3:
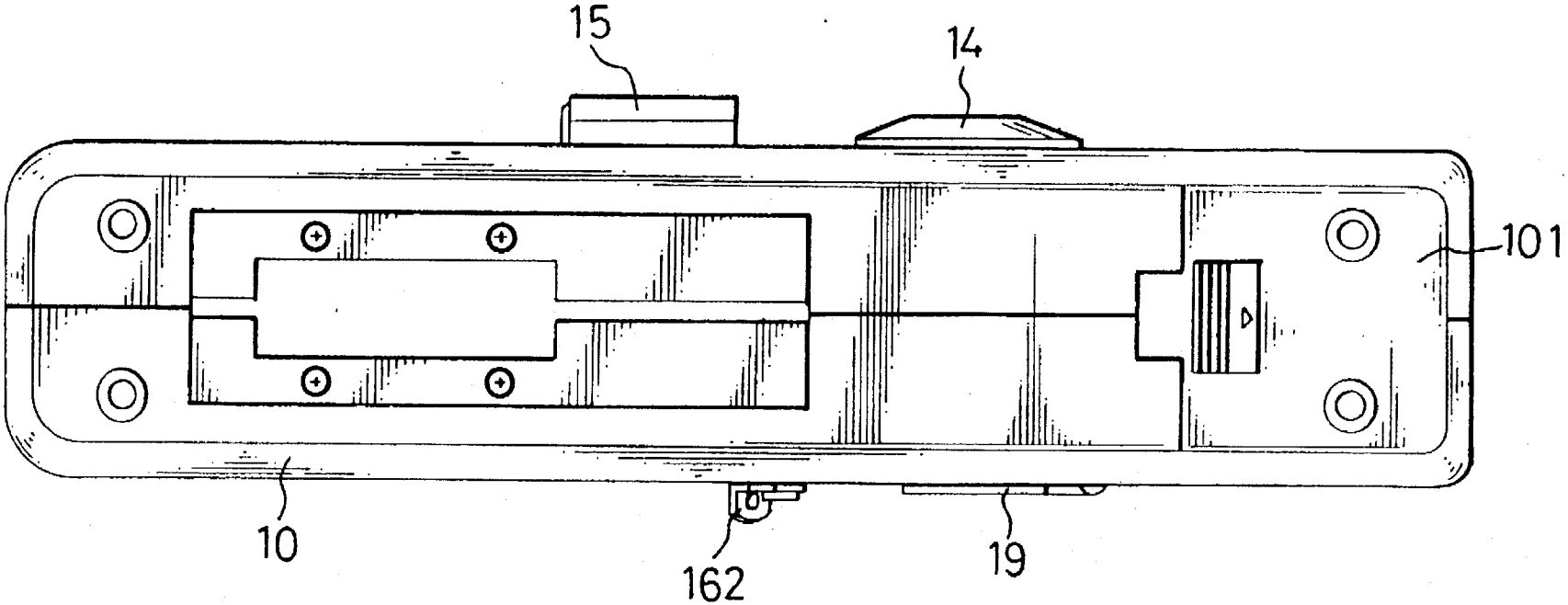
FIG. 3 is a bottom schematic view of the invention.

Referring to FIG. 2 of a side view of the present invention taken in another direction, wherein a bobbin winder switch 19 and a presser foot lifter 51 are provided on the other side of the main housing 10, a fifth guider 162 is thus mounted on top of the presser foot lifter 51. A battery compartment cover 101 mounted at a rear part of the main housing 10 is shown in FIG. 3. A user may open the battery compartment cover 101 to replace the battery received therein.

Figure 4:
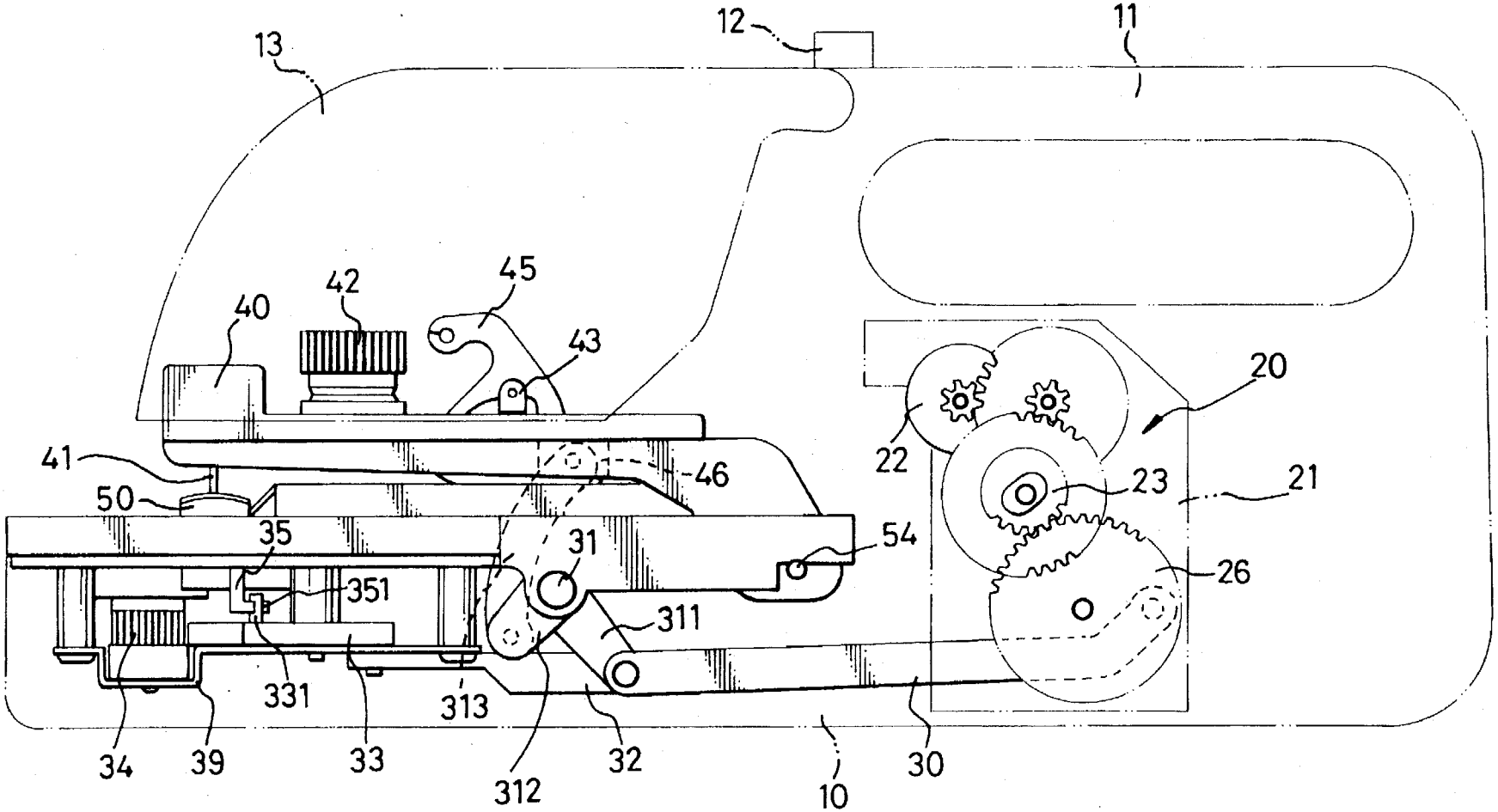
FIG. 4 is a plan view showing the internal mechanism of the invention.

From FIG. 4, it is noted that a deceleration-gear-set 20 powered by a motor 22 is provided within the main housing 10 for decelerating the power of the motor 22. The power of the motor 22 drives a detachable gear 23 having a winding axis 233 inseted therein to turn and consequently rotates a driving gear 26 through a series of mated gears (not numbered). A driving rod 30 is pivotally and peripherally connected with the driving gear 26, therefore, the driving rod 30 will have horizontal movement when the driving gear 26 is turned by the power of the motor 22.

Figure 5:
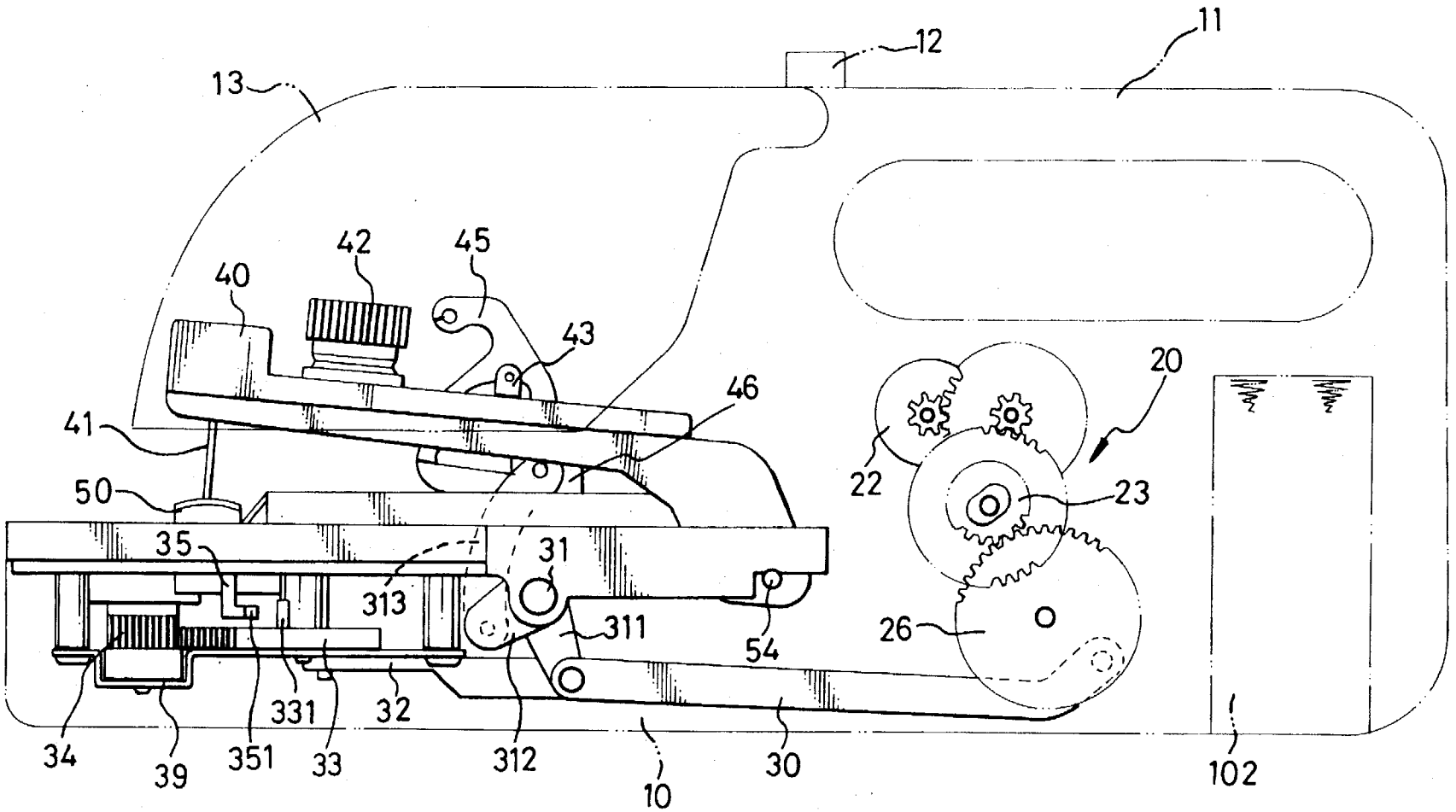
FIG. 5 is a schematic view showing the operation of the internal mechanism of FIG. 4.

A front end of the driving rod 30 is pivotally connected with a front rod 311 which is integrally formed with a rear rod 312 of a transmitting shaft 31 and an elevation rod 313 is pivotally connected with the rear rod 312 at its lower end (not labeled). An upper end of the elevation rod 313 is also pivotally connected to a plate 46 to a bottom face of the needle arm 40 positioned at a plate 46. Incorporated with FIG. 5, it is noted that when the driving rod 30 is forced to move horizontally by the driving gear 26, the front rod 311 will turn, and thus the transmitting shaft 31 turns clockwise, which the elevation rod 313 will be lifted upward because of the rear rod 312 integrally formed with the transmitting shaft 31. Due to the horizontal movement of the driving rod 30 and the upward and downward movement of the elevation rod 313, the needle arm 40 is able to move up and down to fulfill the movement needed for a sewing operation.

As discussed before, the manual adjusting wheel 14 is used to adjust various positions of the needle arm 40, so that a user is easier to have a thread inserted into the needle and an easier access to load and unload the fabric.

A driven rod 32 extended toward the bed 18 is also pivotally connected at the place where the driving rod 30 is pivotally connected with the front rod 311, thus the power of the motor 22 is transmitted toward the bed 18. An assembling plate 39 having mechanism (not shown) to drive a shuttle and a feed dog 35 (not shown in this Figure) is provided with a pivotally connected sectorial gear 33. A front end of the driven rod 32 is pivotally connected with the sectorial gear 33 and a gyration gear 34 mated with the sectorial gear 33 is pivotally connected in front of the sectorial gear 33 and onto the assembling plate 39. Therefore, the gyration gear 34 will turn back and forth when the turning of the sectorial gear 33 is activated by the horizontal movement of the driven rod 32.

Figure 6:
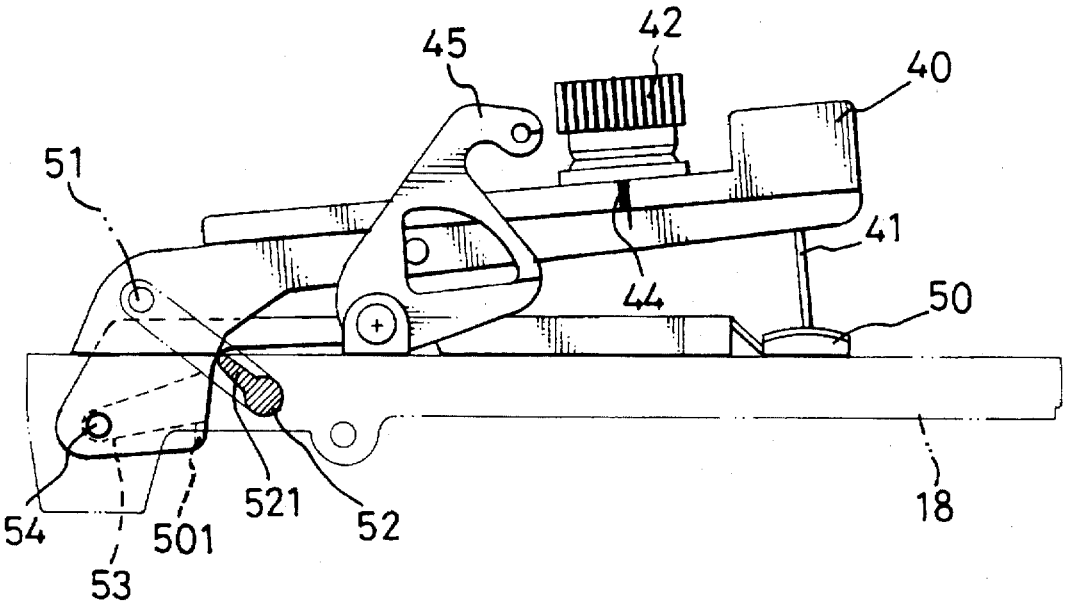
FIGS. 6 and 7 are schematic views of the structure and the operation of a pressing plate constructed in accordance with the present invention.
Figure 7:
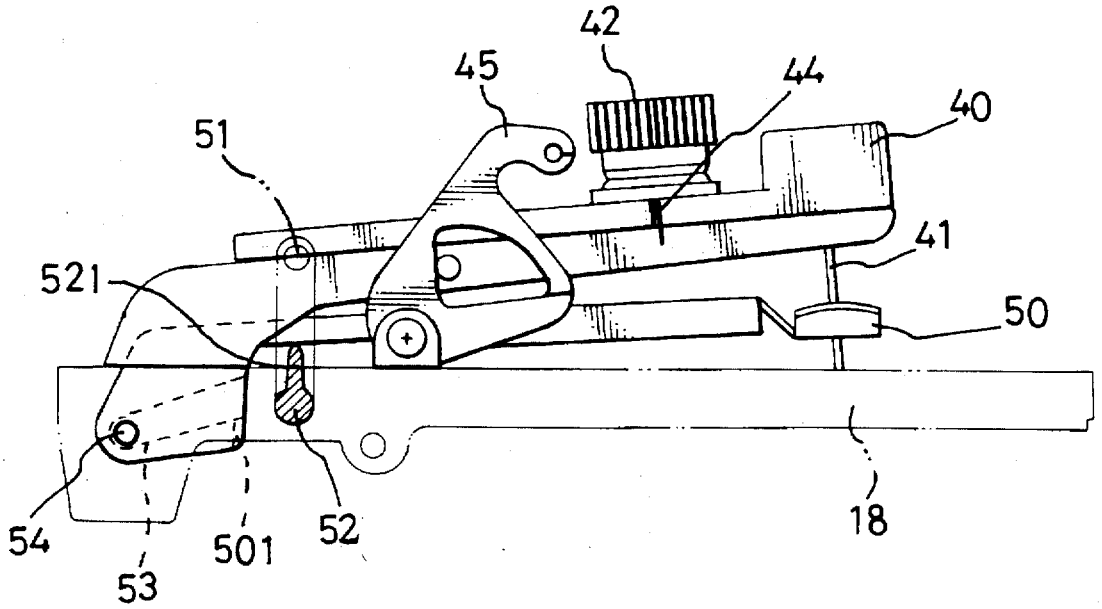

It is well known to the people that before sewing is started, it is necessary to first insert a fabric to be knitted under a needle and use a device to hold the fabric in steady position, such that the sewing operation may be regularly done. Referring to FIG. 6 and FIG. 7, they show the upward movement of a presser foot 50 permitting said fabric to be inserted. It is again noted that the presser foot 50 is pivotally connected with the needle arm 40 at the same axis 54 having a resilient member 53 mounted therewith. One end of the resilient member 53 abuts against an inner face of the bed 18, the other end of the resilient member 53 is then abutting against a flange 501 of the presser foot 50, so that the resilient member 53 is able to provide a downward resilient force to the presser foot 50 to allow said fabric to be inserted thereunder. A presser foot lifter 51 having an integrated-formed adjusting protrusion 521 is pivotally connected with the bed 18 at an axis 52, and one end of the adjusting protrusion 521 abuts against a bottom face of the presser foot 50, so that the presser foot 50 will be lifted upward when the presser foot lifter 51 is manually adjusted to the right as shown in FIG. 7.

Figure 8:
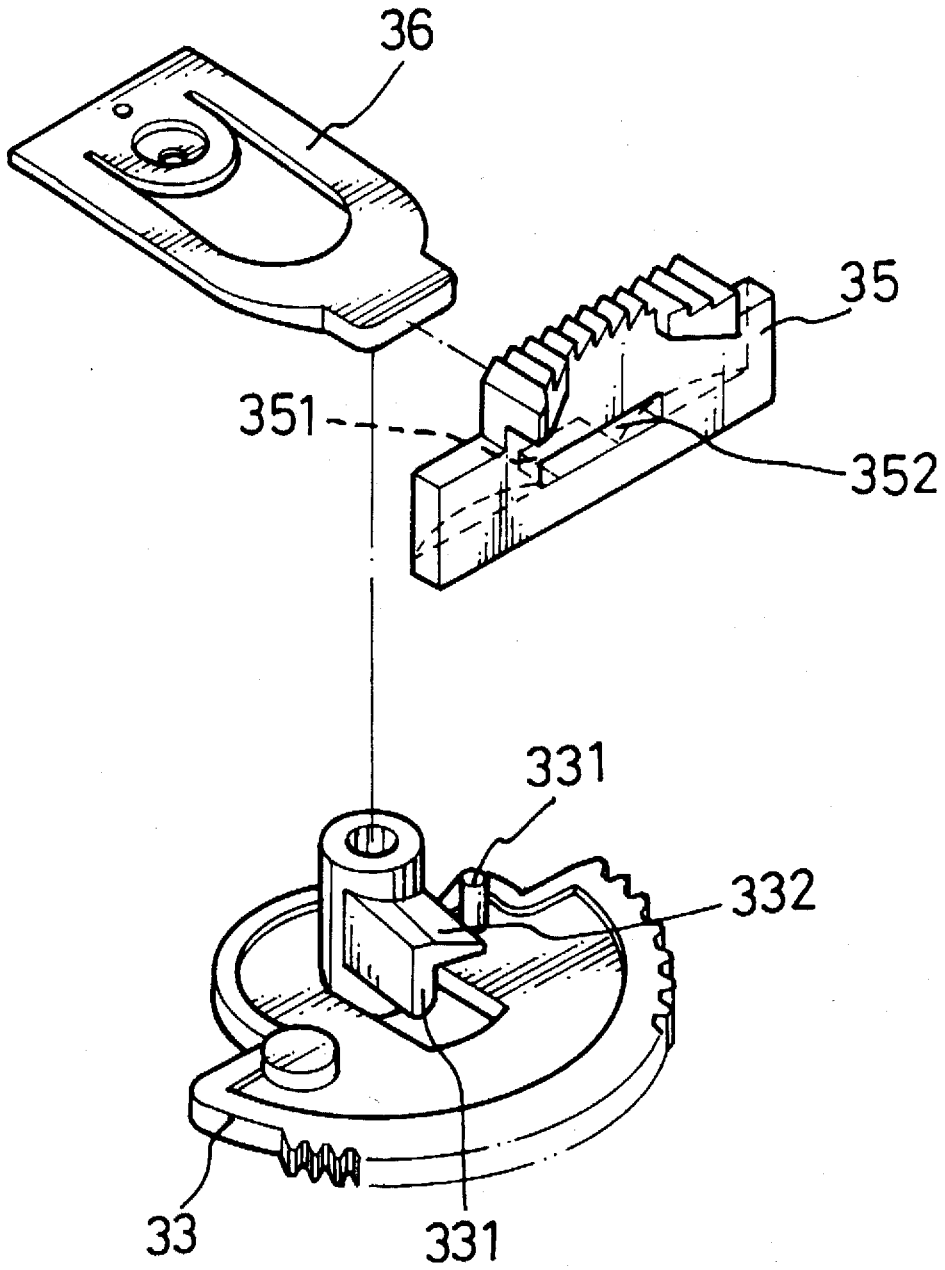
FIG. 8 is an exploded view of a sectorial gear, a feeding dog and a resilient member.
Figure 9:
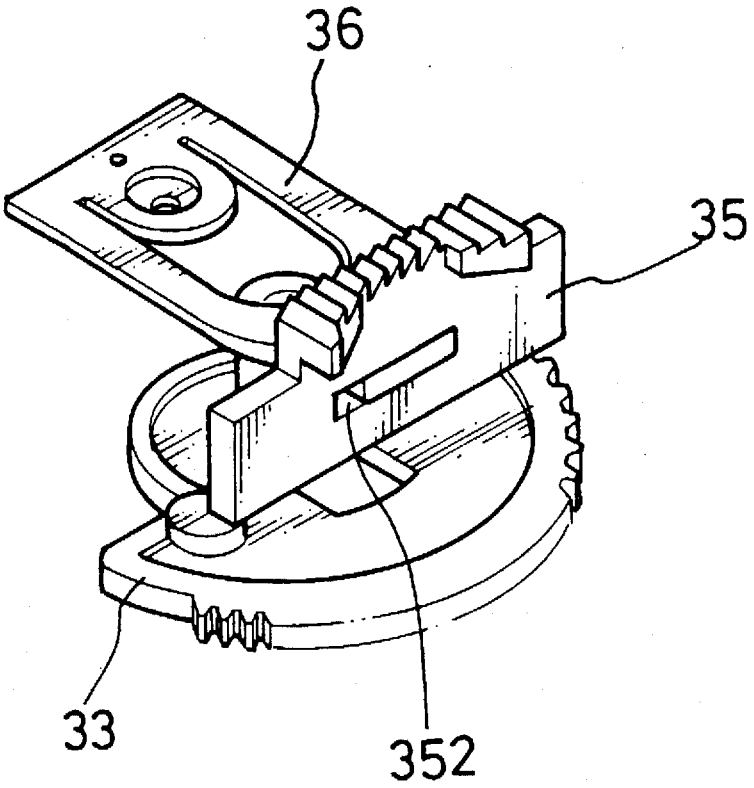
FIG. 9 is a perspective view of the sectorial gear, a feeding dog and a resilient member, when in combination.

Referring to FIGS. 8 and 9 wherein, on the sectorial gear 33, a central tube (not numbered) is provided on the upper face (not labeled) thereof, at least two lugs 331 are provided and spaced apart. One of the lugs 331 is provided between the sectorial gear 33 and a top plate 332 formed integrally with the central tube and having an inclined top surface. The upper part of a feed dog 35 is formed with wavy form and the lower rear part extends outward a projection 351 configured to mate the lug 331, such that the feed dog 35 is driven by the lugs 331 to swing left and right. A recess 352 formed integrally with the feed dog 35 for receiving a resilient member 36. Therefore, it is apparent to be noted that a free end (not shown) of the resilient member 36 is inserted into the recess 352 of the feed dog 35 for providing a recoil force to the feed dog 35.

Figure 10:
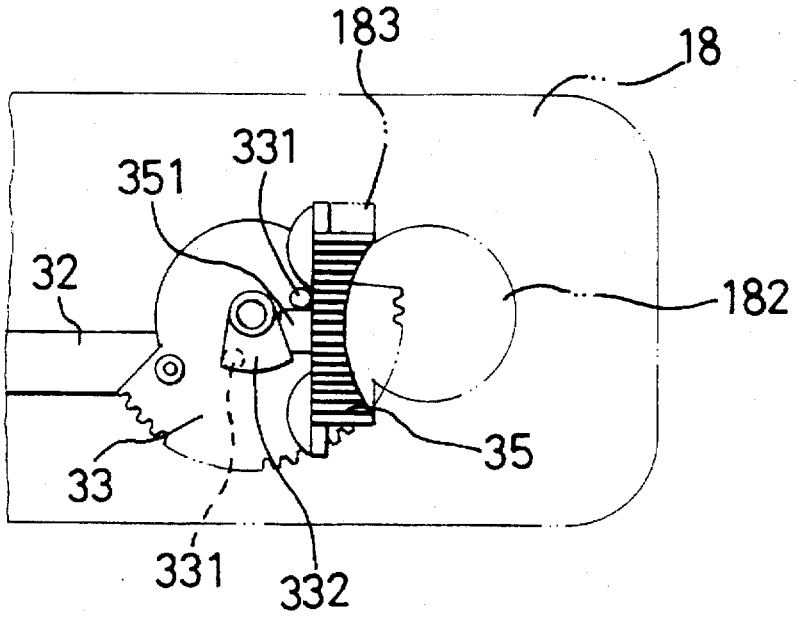
FIGS. 10 and 11 are top views of horizontal movement of a feeding dog because of a sectorial gear and multiple pushing rods.
Figure 11:
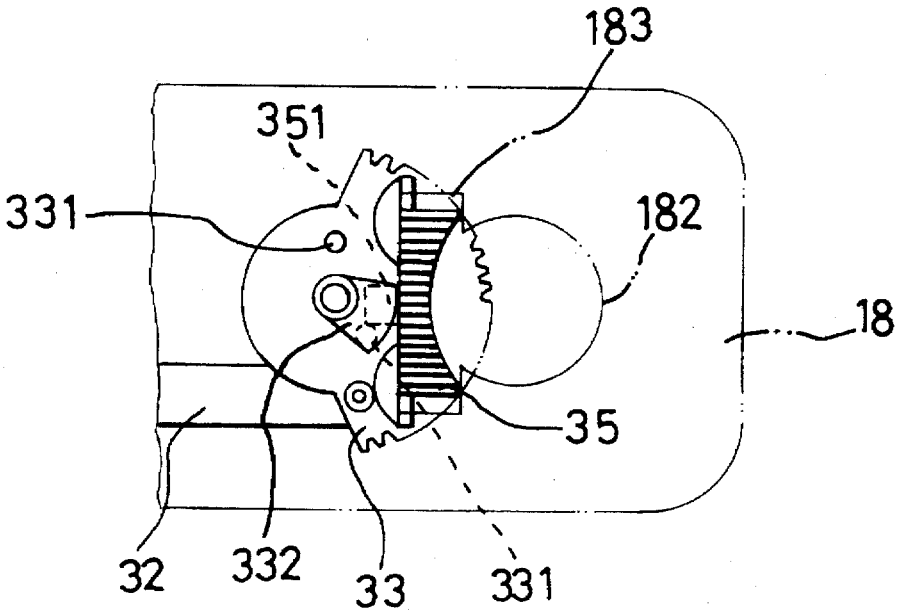
Figure 12:
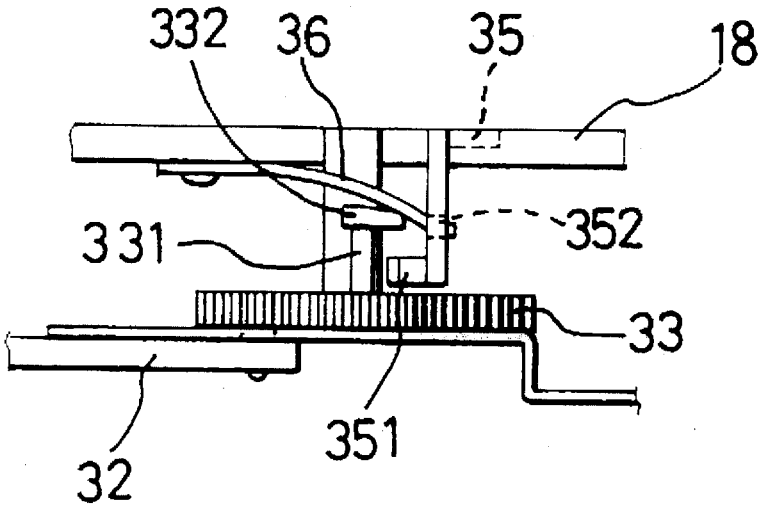
FIGS. 12 and 13 are side views of vertical movement of the feeding dog because of the sectorial gear and a top plate.
Figure 13:
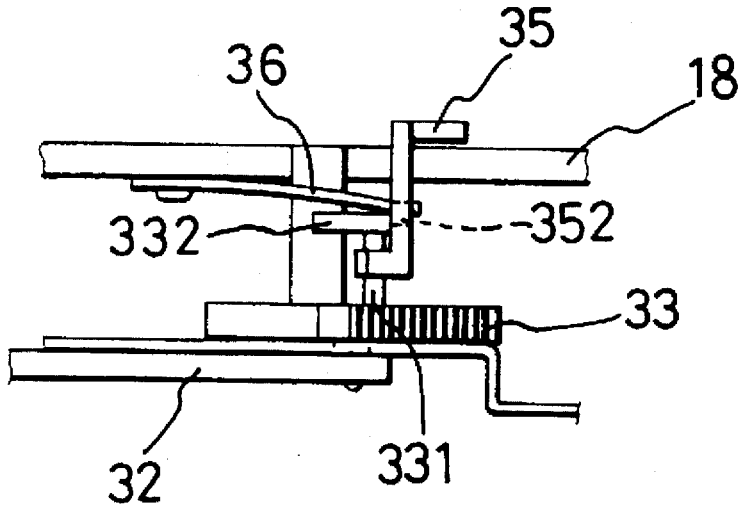

Referring to FIGS. 10 and 11, a plurality of lugs 331 are formed integrally with the sectorial gear 33 and the lugs 331 are able to move the feed dog 35 received within a slot 183 of a shuttle housing 182 and having smaller size comparing to the size of the slot 183 to move from the left to the right and vice versa by a projection 351 formed on a bottom face of the feeding dog 34 when the sectorial gear 33 is turned.

It is also well known in the art that the knitted fabric has to be gradually pushed forward in order that the knitted apparatus is able to continue to perform the next sewing procedure. A top plate 332 integrally formed and co-axial with the sectorial gear 33 is provided on top of one of the lugs 331. One end of a resilient element 36 is securely fixed on a bottom face of the board 18 and the other end of the resilient member 36 is inserted into a recess 352 defined within the feed dog 35. The position shown in FIG. 10 is corresponding to the position of FIG. 10 where a top face of the feed dog 35 is aligned with the surface of the board 18. The top plate 332 will make the resilient member 36 moving upward and so as to the feed dog 35, when the sectorial gear 33 is turned due to the power transmitted by the driven rod 32, as shown in FIG. 11. The feed dog 35 will resume to its original position due to the resilient force of the resilient member 36 when the sectorial gear 33 turns to the other direction.

Another advantage of the invention is that the detachable gear 23 may be used as a thread winding element.

Figure 14:
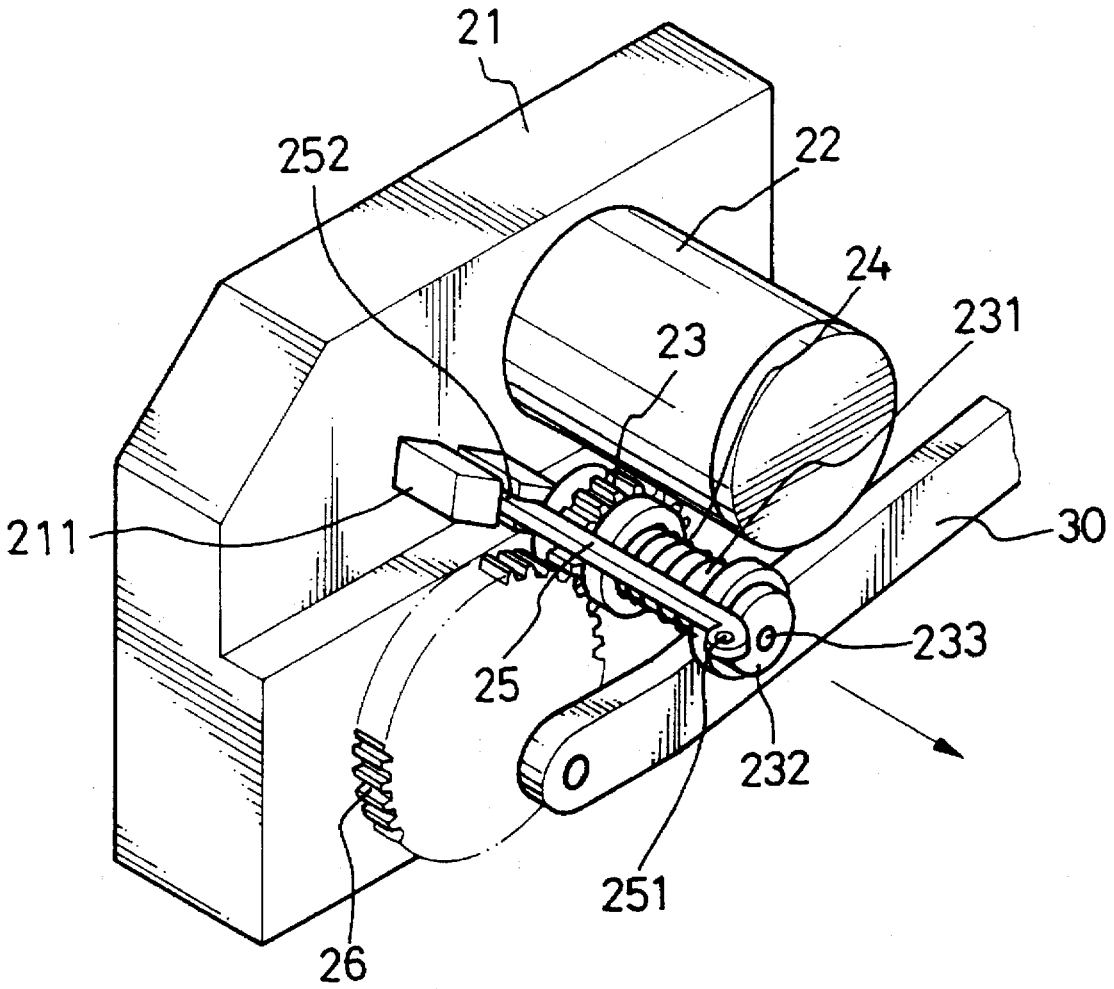
FIG. 14 is a schematic view of the related position of a detachable gear and a driving gear.
Figure 15:
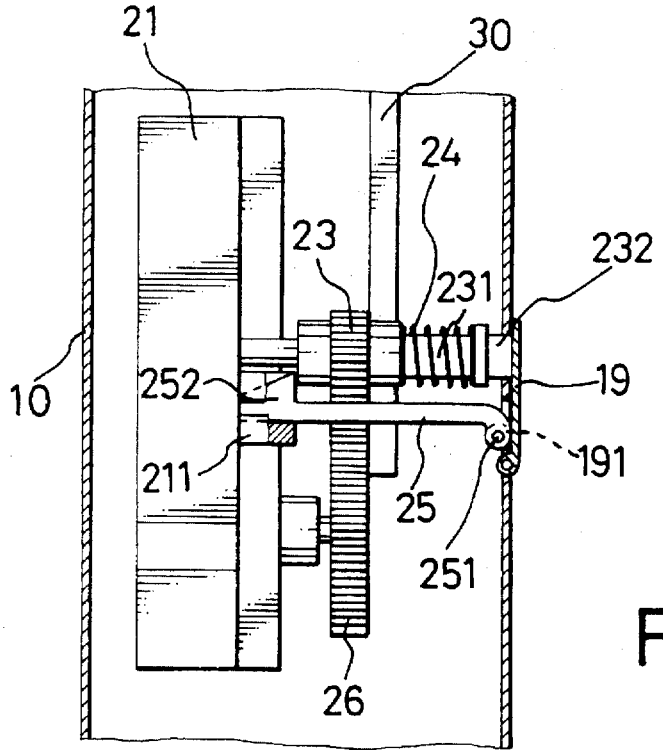
FIGS. 15 and 16 are schematic views of the movement of the detachable gear and the separation of the detachable gear and the driving gear.
Figure 16:
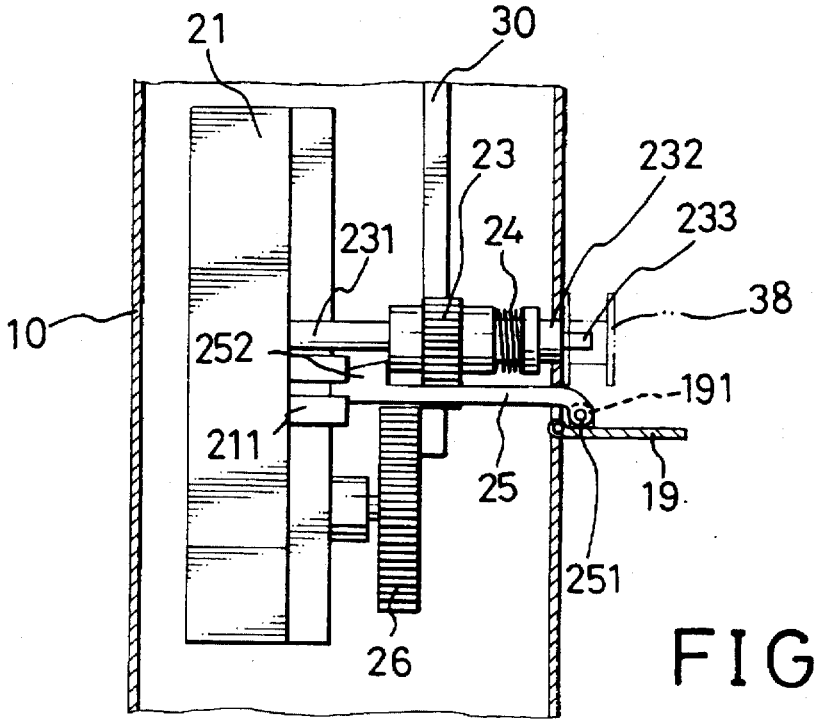

Referring to FIG. 14 and taking FIG. 15 and FIG. 16 as reference, the motor 22 is mounted on a gear seat 21, the detachable gear 23 is mated with the driving gear 26 and the driving rod 30 is peripherally and pivotally connected with the driving gear 26. A bobbin winder shaft 231 having the detachable gear 23 received thereon has a coil spring 24 situated between the detachable gear 23 and a stop 232 provided on a free end of the bobbin winder shaft 231. A smaller and thinner winding axis 233 having the detachable gear 23 inserted therein is received within the bobbin winder shaft 231. A hook 25 received within a slot 211 has a through hole 251 on one end and a head 252 securely connected with an inner side of the detachable gear 23 on the other end. The through hole 251 of the hook 25 is pivotally connected with the bobbin winder switch 19 at a point 191 and the stop 232 is received within a hole (not numbered) of the bobbin winder switch 19. Therefore, when the bobbin winder switch 19 is opened, the hook 25 will be pulled outward, and because the head 252 is securely connected with the detachable gear 23, thus the detachable gear 23 will no longer be mated with the driving gear 26, and the winding axis 233 will extend outward from the surface of the main housing 10 as a thread winding device. The coil spring 24 will be compressed when the bobbin winder switch 19 is opened, thus the detachable gear 23 will be pushed back to a position where the detachable gear 23 and the driving gear 26 are mated with each other.

Figure 17:
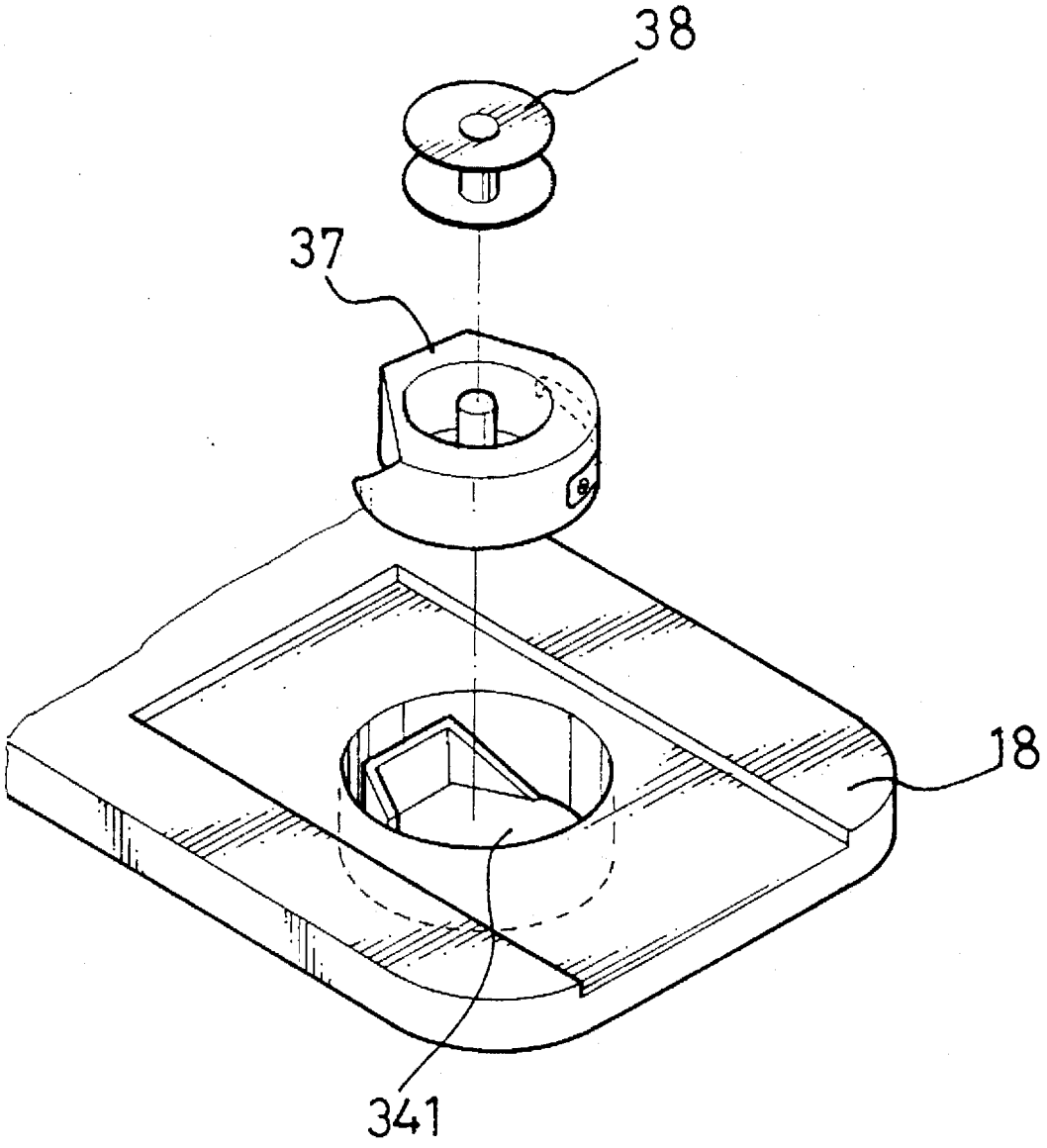
FIG. 17 is an exploded view of the lower thread mechanism.

Referring to FIG. 17, the lower thread mechanism, as we described before, comprises a lower thread bobbin 38, a shuttle 37, a shuttle housing 341 situated within the board 18 and providing space to the shuttle 37 to move back and forth due to the rotation of the gyration gear 34 which is mated with the shuttle housing 341. Since the operation principle of the lower thread mechanism is well known in the art, it is not necessary to further describe the operation and the related members of the lower thread mechanism.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A portable sewing machine comprising:

a driving means having:

a main housing;

a motor received within said main housing;

a handle mounted on said main housing;

a bed extending forward and defined integrally with said main housing; and a gear seat provided with a deceleration gear having a detachable gear and a driving gear pivotally connected with a driving rod;

a transmitting means having:

a needle arm pivotally connected with said main housing;

a transmitting shaft having a front rod pivotally connected with said driving rod and a rear rod pivotally connected with an elevation rod which is pivotally connected with said needle arm;

a driven rod pivotally connected with said driving rod and said rear rod of said transmitting shaft;

a sectorial gear pivotally connected with said driven rod and having a plurality of integral lugs and a top plate;

a gyration gear mated with said sectorial gear;

a presser foot pivotally connected with said needle arm through an axis;

an adjusting rod pivotally connected with said bed, having an adjusting protrusion abutting a bottom face of said presser foot;

a coil spring securely fixed between a bottom face of said bed and an inner surface of said presser foot for providing a downward force to said presser foot; and a feed dog mated with said sectorial gear, having a projection; and a plurality of guiding means mounted on said main housing for providing proper direction to threads.

2. The portable sewing machine as claimed in claim 1, wherein one end of a resilient member is securely provided to a bottom face of said bed and the other end is inserted into a recess of said feed dog.

3. The portable sewing machine as claimed in claim 1, wherein said driving gear is detachably mated with said detachable gear.

4. The portable sewing machine as claimed in claim 1, wherein said transmitting means further has a winding axis extendably inserted into said detachable gear.

5. The portable sewing machine as claimed in claim 1, wherein said main housing further has a hood pivotally connect thereto.

6. The portable sewing machine as claimed in claim 5 further comprising a hook pivotally connected with said hood, having a head for abutting said detachable gear.

7. The portable sewing machine as claimed in claim 1, wherein said main housing further has a manual adjusting wheel mounted thereon for adjusting the tension of said threads.

8. The portable sewing machine as claimed in claim 1 further comprising a spool stand with a spool pin pivotally connected thereto.

* * * * *